United States Patent [19]

Phillips

[11] Patent Number: 4,800,273

[45] Date of Patent: Jan. 24, 1989

[54] SECONDARY ION MASS SPECTROMETER

[76] Inventor: Bradway F. Phillips, P.O. Box 201526, Bloomington, Minn. 55420

[21] Appl. No.: 141,588

[22] Filed: Jan. 7, 1988

[51] Int. Cl.[4] ..... H01J 49/04

[52] U.S. Cl. ..... 250/288; 250/309; 250/396

[58] Field of Search ..... 250/309, 288, 489, 305, 250/396; 313/360.1, 361.1, 363.1

[56] References Cited

U.S. PATENT DOCUMENTS

| | | | |
|---|---|---|---|
| 2,939,952 | 6/1960 | Paul et al. | 250/41.9 |
| 3,517,191 | 6/1970 | Liebl | 250/49.5 |
| 3,617,741 | 11/1971 | Singbahn | 250/49.5 |
| 3,939,344 | 2/1976 | McKinney | 250/281 |
| 4,132,892 | 1/1979 | Wittmaack | 250/309 |
| 4,296,323 | 10/1981 | Gerlach | 250/289 |
| 4,481,415 | 11/1984 | Takeda et al. | 250/292 |
| 4,556,794 | 12/1985 | Ward et al. | 250/309 |

OTHER PUBLICATIONS

Witmaack, "Design and Performance of Quadrupole-Based SIMS Instruments", (6/81), pp. 65-89 *Vacuum.*

Liebl, "Beam Optics in Secondary Ion Mass Spectrometry", (1981), *Nuclear Instruments and Methods,* pp. 143-151.

Liebl, "Ion Optics of Ion Microprobe Instruments", (1983) *Vacuum,* pp. 525-531.

Inglebert et al, "Overall Transmission of Quadrupole Mass Spectrometers", (1980), *Advance in Mass Spectrometry,* pp. 1764-1770.

Liebl, "Optimum Sample Utilization in Secondary Ion Mass Spectrometry", (1982) *Nuclear Instruments and Methods.*

Campana et al, "Application of Dynamic Emittance Matching to Secondary Ion Mass Spectrometry", (1981), *Rev. Sci Instrum.,* pp. 1517-1520.

Liebl, "Ion Microprobe Analysers", (1974), *Analytical Chemistry,* pp. 22-30, vol. 46.

Mayer et al, "Comparison of Surface Layer Analysis Techniques", (1973), *Thin Solid Films,* pp. 1-10.

Honig, "The Growth of Secondary Ion Mass Spectrometry".

Maeda, "Electron Energy Analysis Using an Einzel Lens", (1982), *Jpn. J. Appl. Phys.* vol. 21, pp. 671-673.

Chase, "The Geometrical Factor of Large Aperture Hemispherical Electrostatic Analyzers", (1973), *Rev. Sci. Instrum.* vol. 44, pp. 998-1002.

Nishigaki et al, "Optimization of the Herzog Correction in the Hemispherical Deflector Analyzer", (1986), *Rev. Sci. Instrum.* vol. 57, pp. 225-228.

Liebl, "Ion Optics for Surface Analysis", (1978), *Inst. Phys. Conf. Ser. No. 38* ch:6, pp. 266-281.

*Primary Examiner*—Bruce C. Anderson
*Assistant Examiner*—Jack I. Berman
*Attorney, Agent, or Firm*—Paul L. Sjoquist

[57] ABSTRACT

Secondary ion mass spectrometer system having an ion collection lens including three conical lens sections, aligned along an axis, deflection plates for dynamically deflecting an ion beam along this axis, wherein the combination of lens sections and deflection plates focus the ions at an entrance aperture of an ion energy spectrometer formed by two 90° sectors of spherical arcuate plates, an ion deceleration lens, a quadrupole mass spectrometer, and an ion detector. In combination, the three conical lens sections accelerate ions from a specimen surface, decelerate these ions into an ion energy spectrometer for energy window matching to the quadrupole mass spectrometer, and focus the ions on the entrance aperture of the ion energy spectrometer.

6 Claims, 1 Drawing Sheet

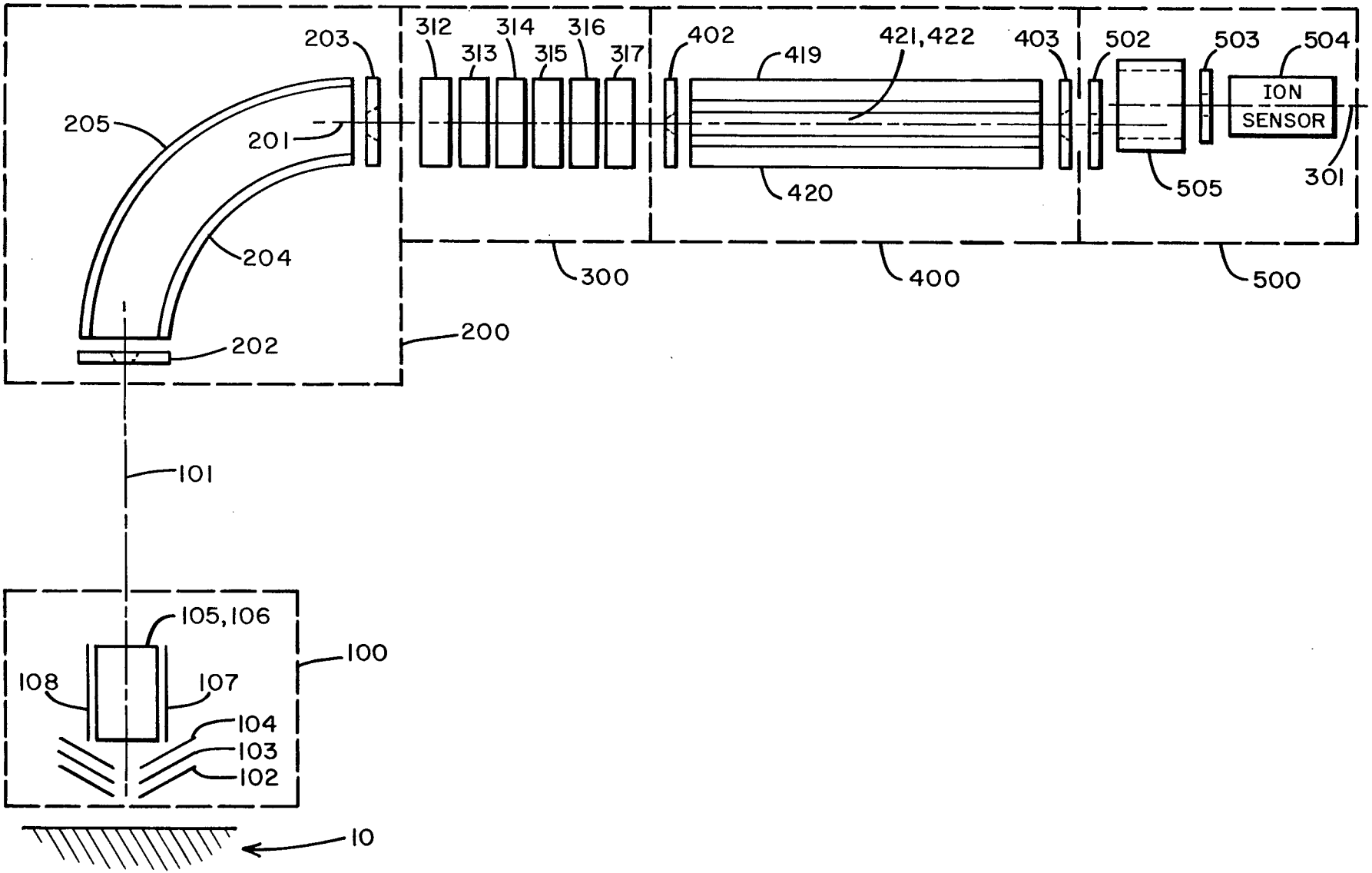
ION SENSOR
504
503
502
301
500
505
403
421,422
400
419
420
402
317
316
315
314
313
312
300
200
203
201
204
202
205
101
100
105,106
107
104
103
102
108
10

SECONDARY ION MASS SPECTROMETER

BACKGROUND OF THE INVENTION

The present invention relates generally to mass spectrometry of secondary particles, charged either positively or negatively, which are emitted when solids or liquids absorb energy from primary particles, including photons. More particularly, the invention relates to apparatus for obtaining measurements of secondary ions, in systems which have become known as secondary ion mass spectrometry (SIMS) devices. Such devices have been known generally for a number of years, and continual progress in improving the accuracy and adaptability of such devices has been made over the years. The present invention is yet a further improvement in SIMS devices.

An early patent in the field of SIMS devices is U.S. Pat. No. 3,517,191, issued June 23, 1970 to Liebl. This patent discloses an electrostatic ion energy analyzer followed by a magnetic mass spectrometer. Another early patent, U.S. Pat. No. 2,939,952, issued June 7, 1960, to Paul et al discloses a quadrupole mass spectrometer. A subsequent patent, U.S. Pat. No. 3,939,344, issued Feb. 17, 1976 to McKinney, discloses a SIMS device utilizing a quadrupole mass spectrometer. Subsequently, U.S. Pat. No. 4,132,892 issued Jan. 2, 1979 to Wittmaack, disclosed a raster scanning ion microprobe for determining, with a large field of view, the lateral distribution of elements, isotopes and compounds at the surface and in the bulk of solid specimens for displaying the surface topography of the sample. This device also utilized a quadrupole mass analyzer to allow imaging of the specimen with a large field of view U.S. Pat. No. 4,296,323, issued Oct. 20, 1981 to Gerlach, discloses an improved SIMS device having a focusing ion collection lens, quadrupole mass analyzer, and an electron multiplier-type ion detector. U.S. Pat. No. 4,556,794, issued Dec. 3, 1985 to Ward et al discloses a SIMS device having a secondary ion collection and transport system which is very compact and can be used with a small working distance, thereby enabling the primary ion beam to have a short focal length and high resolution, and collect the secondary ions on the same axis as the primary ion beam. The transport section consisted of a plurality of spaced conductive members which are coaxial with and distributed along the desired ion path, and relatively high voltages were applied to alternate transport sections to produce accelerating electric fields sufficient to transport the ions through the section to an ion mass analyzer, while lower voltages were applied to the other transport sections to focus the ions and bring their velocity to a level compatible with the analyzing apparatus.

U.S. Pat. No. 3,617,741, issued Nov. 2, 1971 to Siegbahn et al discloses an electron spectroscopy system with a multiple electrode electron lens, utilizing a hemispherical plate electrostatic analyzer, specifically for analysis of X-ray induced photoelectrons, but generally of a type able to energy-analyze charged subatomic particles, atomic or molecular particles. U.S. Pat. No. 4,481,415, issued Nov. 6, 1984 to Takeda et al discloses a specific form of quadrupole mass spectrometer, which includes a modification to collimate and focus both low- and high-mass charged particles at the same point on the detector.

The foregoing patents disclose SIMS devices and specific elements for incorporating therein, and represent improvements over similar devices previously disclosed. The present invention likewise includes improvements over prior art devices, the result being an overall improved secondary ion mass spectrometer apparatus.

SUMMARY OF THE INVENTION

The invention includes an improved SIMS device having an ion collection lens formed of three spaced conical sections for focusing ions emitted from a specimen surface onto the entrance of an ion energy spectrometer, and a electrostatic ion deflector positioned immediately adjacent to the collection lens. The ion energy spectrometer consists of two 90° sectors of spherical arcuate plates having an entrance aperture aligned along the axis of the collection lens, and an exit aperture aligned with the axis of an ion bunching and deceleration lens. The ion bunching and deceleration lens is known in the art, and is aligned with the axis of a quadrupole mass spectrometer having an entrance aperture and an exit aperture held at non-zero voltage potentials; the exit aperture is aligned along the primary (entrance) axis of an ion detector which converts the ions into a signal that can be quantified in an electronic detection system.

It is an object of the present invention to provide an improved SIMS device by incorporating therein an improved ion collection lens and deflection plates It is a further object of the present invention to provide an improved ion energy spectrometer as one element of an improved SIMS device.

It is another object of the present invention to improve the ion bunching and deceleration lens element of an SIMS device.

It is a further object of the present invention to improve an SIMS device by incorporation therein of an improved ion detector.

The foregoing and other objects and improvements will become apparent from the following specification and claims, and with reference to the appended drawings.

BRIEF DESCRIPTION OF THE DRAWING

The invention is illustrated in the single drawing appended hereto.

DESCRIPTION OF THE PREFERRED EMBODIMENT

Referring to the drawing, there is shown a secondary ion mass spectrometer in diagrammatic form. The device exists in several sections, each section associated with a portion of the functional operation of the overall device, and each section having relation to earlier devices in the prior art, and in combination being distinguishable thereover. In general, the specimen to be analyzed is designated as 10, and ions released therefrom are transported through the ion collection lens and deflection plates 100, generally along an axis designated as 101. The ions are focused at the entrance aperture of the ion energy spectrometer 200, are deflected through a 90° angle and are emitted along an axis 201 which passes through an ion deceleration lens 300, a quadrupole mass spectrometer 400, and into an ion detector 500. The structure and operation of each of the elements of the secondary ion mass spectrometer device will be described in the following paragraph.

The structure and apparatus of the equipment required to produce the primary ion, electron, or photon beam is omitted from the present disclosure. It is presumed that primary beam structures are well known in the art, and many of the prior art structures would be usable with the present invention, it being required only that the primary beam be directed to the specimen surface 10, proximate the region adjacent the lens opening of the ion collection lens and deflection plates 100. The secondary ions emitted as a result of applying a primary beam are conveyed according to the teachings of the present invention. In the discussion of voltage levels and voltage polarities herein, the values given are for the analysis of positive ions. In general, negative ions may be analyzed merely by inverting the polarity of the applied voltage potentials.

Ion Collection Lens With Deflection Plates

The ion collection lens and deflection plates 100 include three spaced conical sections 102, 103, and 104, to form a lens for collecting and focusing ions emitted from the specimen surface 10. An electrostatic field is developed by means of voltages applied to the conical sections, wherein it is presumed that the specimen surface is at a zero voltage potential. In the preferred embodiment, lens element 103 is placed at a voltage potential which is variable between zero and −500 V. The voltage applied to lens element 102 is preferably variable between zero and −100 V in order to provide a voltage range to focus the collected ions on the entrance aperture in aperture plate 202 of ion energy spectrometer 200. The voltage applied to lens element 104 is preferably about −250 V, or in most events less than the voltage applied to lens element 103. It has been found that if lens elements 103 and 104 are held at the same voltage, the spread of ion energies presented to the quadrupole mass spectrometer 400 is determined by the ion energy window of the ion energy spectrometer 200. Since this value is normally 3–5 percent of the energy of the ions, a problem can arise with the operation of the quadrupole mass spectrometer 400. The typical quadrupole mass spectrometer 400 can only pass approximately a 10 electron volt (eV) ion energy spread without affecting resolution or transmission, and if a voltage of −500 V is applied to lens elements 103 and 104, the ion energy spread presented to the quadrupole mass spectrometer will be in the range of 15–25 eV. This will lead to a decrease in the ability of the quadrupole mass spectrometer to separate the individual ion mass peaks. If the voltage on lens element 104 is reduced to approximately −250 V, the resulting ion energy spread presented to the quadrupole mass spectrometer 400 is lowered to the range of 7–12 eV, which is more acceptable to the quadrupole mass spectrometer 400 and preserves the shape and distinction between the individual ion mass peaks. It is generally accepted that the higher the field strength is between a specimen surface and an ion collection lens, the more sensitive the instrument will be. Therefore it is important to apply a voltage of about −500 V to lens element 103, while applying a voltage of about −250 V to lens element 104, to thereby satisfy both the high sensitivity requirement of the instrument and the ion energy requirement of the quadrupole mass spectrometer. The difference in voltage between lens element 103 and lens element 104 effectively accelerates the ions through lens element 103, and decelerates the ions after collection by the lower potential on lens element 104. This feature represents an improvement over the apparatus disclosing the Gerlach U.S. Pat. No. (4,296,323).

Immediately adjacent the ion collection lens, formed by lens elements 102, 103 and 104, is found an electrostatic ion deflector. The electrostatic ion deflector is formed by two pair of elongated metal plates at right angles to each other and parallel to axis 101. One pair of parallel plates 105, 106 is placed on two sides of axis 101, and the second pair of parallel plates 107, 108 is placed on the two other sides of axis 101.

The electrostatic ion deflector may be operated in two modes, the first of which is referred to as the static mode. In the static mode, the voltage potential on all four plates is initially set to the same value as the voltage of lens element 104. Subsequently, the voltages on the respective plates are varied by small amounts in order to align the ion beam to coincide with axis 101, or more particularly, to become deflected to the entrance aperture 202 of ion energy spectrometer 200. In practical operation, the use of the ion collection lens with deflection plates 100 causes the zone of maximum ion collection to lie along the axis 101, with a near gaussian fall-off in collection efficiency as the radial distance from axis 101 increases.

A second mode of operating the electrostatic ion deflector is called the dynamic emittance matching mode. This mode is particularly useful in expanding the secondary ion collection area of the lens. Dynamic emittance matching is described in the Liebl patent (3,517,191) and is used in connection with a primary beam which is rastered over the surface of the specimen 10. In this event, a portion of the voltage which is used to produce the beam raster of the primary beam is also impressed upon the pairs of deflection plates 105, 106 and 107, 108 in order to produce an opposing deflection effect to that occurring with the primary beam. For example, when the primary beam moves to the "right" along the specimen surface 10 the collection lens elements 102, 103, 104 would tend to focus the ions to the "left" of the entrance aperture 202 to bring the ion stream out of alignment with axis 101. However, by applying a portion of the raster-creating voltage to the deflecting plates, the opposing forces of the respective voltages on the deflecting plates pushes the focal point of the ions back toward axis 101, and back into alignment with entrance aperture 202.

Another use for the deflecting plates described above is to prevent ions from impinging upon the entrance aperture 202 in certain selected instances. This feature is most useful when the primary beam being used to produce the secondary ions is smaller than the collection lens acceptance area, and one wishes to examine layers of the specimen 10 below its surface. This is normally done by allowing the primary beam to be scanned over the specimen surface in a pattern which results in a crater being formed with a flat bottom. One consequence of this action is that whenever the primary beam is close to the edge of this crater, ions are removed from areas of the crater sidewalls which represent depths from the surface of the specimen to the bottom of the crater. If the voltages on one or both of the pairs of deflecting plates are changed drastically as a function of the nearness of the primary beam to the edge of the crater, the contribution of ions from the crater edge can be reduced by many orders of magnitude, because the focus of the ions will be moved away from entrance aperture 202. Therefore, the resulting data which is collected will be more representative of the material at the bottom of the crater.

Ion Energy Spectrometer

The ion energy spectrometer 200 is similar to the type generally described in the Siegbahn patent (3,617,741). This patent describes the use of a spherical energy analyzer to separate electrons by their energy, to thereby produce a system for analyzing the chemistry of the surface. The hemispherical analyzer has a unique feature in that it has an energy focal point at its entrance and at its exit. The present invention utilizes a 90° sector so that ions focused at an entrance aperture 202 will be dispersed in energy at an exit aperture 203. Another patent which discloses a similar device is the Gerlach Pat. No. (4,296,323).

The ion energy spectrometer 200 includes two 90° sectors of spherical arcuate plates 204 and 205, arranged about a circular axis and aligned with axis 101 at entrance aperture 202. The exit aperture 203 is aligned along the axis 201. The aperture plates 202 and 203 are constructed to act as "Herzog" plates which compensate for the fringe electrostatic fields normally found at either end of an energy analyzer. In order to adjust the energy transmission window of the ion energy analyzer 200, and the size of the ion beam focused upon the entrance aperture of the quadrupole mass spectrometer 400, entrance aperture 202 may be implemented as an aperture having a variable diameter The voltage applied to entrance aperture 202, and the voltage applied to exit aperture 203, is the same as the voltage applied to lens element 104. The voltages applied to arcuate plates 204 and 205 are a complex function of the mechanical design of these plates. In general, the ratio of the radius of plate 204 to that of plate 205 should approach 0.5 in order to maximize ion transmission. The general formula to determine the voltage potentials to be applied to the arcuate plates is a complex function of the energy resolution desired and the diameter of the exit aperture 203. This complex function is well known in the art, and a technique for calculating this voltage is known. For example, see the paper entitled "The Geometrical Factor of Large Aperture Hemispherical Electrostatic Analyzers", by L. M. Chase, published in the Rev. Sci. Instrum., Volume 44, No. 8, August 1973, at page 998. See also the discussion of the paper entitled "Optimization of the Herzog Correction in the Hemispherical Deflector Analyzer", by S. Nishigaki and S. Kanai, published in the Rev. Sci. Instrum., Volume 57, No. 2, February 1986, at page 225. Once a voltage potential has been calculated and established for plates 204 and 205, it may be empirically adjusted by small amounts in order to provide a correct alignment of the ions with exit aperture 203. When this occurs, the detected ion signal is maximized.

Ion Bunching and Deceleration Lens

The ion bunching and deceleration lens 300 utilized with the present invention is essentially described in the patent to Ward et al (4,556,794). The function of this element is to reduce the energy level of the ions emitted from ion energy spectrometer 200 to an ion energy window in the range of 5–15 eV. The ion bunching and deceleration lens consists of a plurality of lens elements 312–317 to which different voltage levels are applied. This multi-element lens is therefore used to decelerate the ions and to reduce their angular deviation from the axis 201. It is accomplished by first accelerating the ions and then decreasing their ion energy in several steps in order to maintain a narrow angle of spread in the ion beam along axis 201. The lens elements 312–317 are coaxial with axis 201, and are essentially electrostatic field members. In operation, voltages of alternately greater and lesser magnitudes are applied to successive lens elements 312–317 to produce electrostatic fields for decelerating and focusing the ion stream along axis 201.

Quadrupole Mass Spectrometer

The quadrupole mass spectrometer 400 was first described in the U.S. Pat. No. 2,939,952 to Paul et al. It has also been described in the U.S. Pat. No. 4,132,892 to Wittmaack and in the U.S. Pat. No. 3,939,344 to McKinney. In the present invention quadrupole mass spectrometer 400 has an entrance aperture plate 402 which is held at the same voltage potential as the lens element 317 in the ion deceleration lens 300, in order to provide the proper voltage potential to alleviate fringe field effects at the entrance of quadrupole mass spectrometer 400. The exit aperture plate 403 is held at a voltage potential between zero and a low negative value to reduce fringe field effects between the ends of the quadrupole rods 419, 420, 421, 422, and exit aperture plate 403. In other respects, quadrupole mass spectrometer 400 may be constructed as described in the foregoing prior art patents.

Ion Detector

The ion detector 500 is similar to the disclosure in the U.S. Pat. No. 4,481,415 to Takeda et al. This patent discloses an offset ion detector using a cylindrical lens to "bunch" the ions. The ion detector 500 converts the individual ions into a signal which can be quantified through an electronic detection system and ion sensor 504. It has an entrance aperture plate 502 which is aligned with axis 201, and is preferably held at a voltage potential of about −500 V. Aperture plate 503 is aligned with axis 301, and has a voltage potential of about −500 V. The apertures in aperture plates 502 and 503 are respectively offset from each other in order to prevent high energy neutralized ions, high energy electrons, and other unwanted particles from entering the ion sensor 504. However, this offset requires that a cylindrical lens 505 be placed between apertures 502 and 503, aligned about axis 301, and that the cylindrical lens be held at a voltage potential somewhat closer to zero volts, in order to deflect the ions of interest into the ion sensor 504. Ion sensor 504 and the aperture through aperture plate 503 are aligned along axis 301 Ion sensor 504 is typically an electron multiplier, structured according to well-known design techniques. Such devices have a sensitivity curve which requires that ions be accelerated by at least several hundred volts in order that the ions will produce sufficient electrons upon striking the electron multiplier. Aperture plates 403 and 502 have a sufficiently different voltage potential to provide this ion acceleration.

A further description of the operation of the ion deflector mechanism formed by aperture plates 502 and 503, and cylindrical lens 505, is found in a paper entitled "Electron Energy Analysis Using an Einzel Lens," by Maeda, published in the Japan Journal of Applied Physics, Volume 21 (1982), No. 4. For example, the cylindrical lens 505 may be held at a voltage potential of about −300 V. This causes the ions to be deflected toward the aperture in aperture plate 503 to improve operation.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A secondary ion mass spectrometer system adaptable for placement in close proximity to a specimen surface, comprising (a) an ion collection lens having three spaced-apart conical sections aligned along a first axis, including a first conical section having means for electrostatically focusing ions into a stream along said first axis, a second conical section having means for electrostatically attracting and accelerating said ions emitted from said specimen surface, and a third conical section having means for electrostatically influencing said ions for energy window matching to an entrance aperture of a quadrupole mass spectrometer;

(b) an electrostatic ion deflector positioned adjacent said ion collection lens, said deflector having four mutually orthogonal plates equally spaced about said first axis;

(c) an ion energy spectrometer having an entrance aperture aligned with said first axis, said ion energy spectrometer further comprising two 90. sectors of spherical arcuate plates having an inlet aligned with said entrance aperture and having an exit aligned with an exit aperture, said exit aperture being aligned with a second axis;

(d) an ion bunching and deceleration lens assembly positioned adjacent said exit aperture and aligned along said second axis;

(e) said quadrupole mass spectrometer having its entrance aperture and having an exit aperture respectively aligned along said second axis; and (f) an ion detector having an entrance aperture aligned along said second axis immediately adjacent the exit aperture of said quadrupole mass spectrometer, said ion detector having means for generating electrical signals responsive to and representative of ions received through said entrance aperture.

2. The system of claim 1, wherein said ion collection lens and said electrostatic ion deflector further comprise, in combination, means for dynamically deflecting ions emitted from said specimen surface onto said ion energy spectrometer entrance aperture.

3. The system of claim 2, wherein said ion energy spectrometer further comprises means for applying a voltage to said entrance and exit apertures.

4. The system of claim 3, wherein said ion bunching and deceleration lens further comprises means for decelerating and focusing ions along said second axis.

5. The system of claim 4, wherein said quadrupole mass spectrometer further comprises means for applying a voltage to said entrance and exit apertures.

6. The apparatus of claim 5, wherein said ion detector further comprises a cylindrical lens positioned adjacent said ion detector entrance aperture and aligned along a third axis, said third axis being parallel to but displaced from said second axis.

* * * * *